US005148186A

United States Patent [19]

Tochihara et al.

[11] Patent Number: 5,148,186

[45] Date of Patent: Sep. 15, 1992

[54] INK JET RECORDING METHOD

[75] Inventors: Shinichi Tochihara, Hadano; Osamu Nishiwaki, Atsugi; Kazuo Iwata, Yokohama, all of Japan

[73] Assignee: Canon Kabushiki Kaisha, Tokyo, Japan

[21] Appl. No.: 700,055

[22] Filed: May 8, 1991

Related U.S. Application Data

[63] Continuation of Ser. No. 488,229, Mar. 5, 1990, abandoned.

[30] Foreign Application Priority Data

Mar. 3, 1989 [JP] Japan ..... 1-51087

[51] Int. Cl.[5] ..... B41J 2/04

[52] U.S. Cl. ..... 346/1.1; 346/140 R

[58] Field of Search ..... 346/1.1, 140, 75, 25

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,376,945 | 3/1983 | Hara | 346/140 |
| 4,459,600 | 7/1984 | Sato et al. . | |
| 4,463,359 | 7/1984 | Ayata et al. . | |
| 4,469,026 | 9/1984 | Irwin . | |
| 4,558,333 | 12/1985 | Sugitani et al. . | |
| 4,712,172 | 12/1987 | Kiyohara | 346/140 X |
| 4,723,129 | 2/1988 | Endo | 346/140 X |
| 4,723,135 | 2/1988 | Yano | 346/140 R |
| 4,740,796 | 4/1988 | Endo et al. . | |
| 4,914,562 | 4/1990 | Abe | 346/140 |

FOREIGN PATENT DOCUMENTS

| | | |
|---|---|---|
| 56847 | 5/1979 | Japan . |
| 85765 | 5/1984 | Japan . |
| 123670 | 7/1984 | Japan . |
| 138461 | 8/1984 | Japan . |
| 71260 | 4/1985 | Japan . |

*Primary Examiner*—Joseph W. Hartary

*Attorney, Agent, or Firm*—Fitzpatrick, Cella, Harper & Scinto

[57] ABSTRACT

An ink jet recording method is disclosed by which, the temperature of the ink droplet discharged from the discharge opening by a discharge signal becomes 60° C. or higher at the printing position of a recording medium, and the volume of the ink droplet when discharged is no greater than 40 pl.

2 Claims, 2 Drawing Sheets

INK JET RECORDING METHOD

This application is a continuation of application Ser. No. 07/488,229 filed Mar. 5, 1990, now abandoned.

BACKGROUND OF THE INVENTION

1. Field of the Invention

This invention relates to an ink jet recording method, particularly to an ink jet recording method by use of plain papers generally used in offices, homes, etc.

2. Related Background Art

Heretofore, various ink jet recording method methods have been investigated and proposed. Among them, the ink jet recording method which performs recording according to the drop-on-demand system has been investigated because miniaturization of instruments is possible and also its application range is extremely wide, so that detailed investigations have been made about ink, paper, mechanism of printer, etc.

However, the ink jet printer of the drop-on-demand system of the prior art has several problems, and the greatest of all is that paper generally used in offices, homes and the like such as notebook, report paper, copying paper, letter paper, post card, etc. cannot be used.

To describe in more detail, when printing is performed on various papers as mentioned above by means of an ink jet printer of the drop-on-demand system, the printed ink is spread along the fibers of the paper and therefore the shape of dot becomes indefinite so as to generate the so called blurring, whereby fine ruled lines, fine letters, complicated Chinese characters defined as JIS second standard and the like will frequently become unclear.

Further, the papers as mentioned above are applied with the treatment called sizing in the paper making process so that blurring may be caused when a writing implement using an aqueous ink is used. When printing is performed by an ink jet printer, the ink will not penetrate the paper well, and the dryability (drying property) of ink at the printed portion becomes poor, involving problems for example, if the print is rubbed with the cover of the printer, it will be smudged, the ink to rub off onto a hand when the printed matter is touched with hand.

Accordingly, for the purpose of improving dryability and decreasing of blurring, various improvements have been made. For example, methods have already been attempted the method in which the pH of the ink is made strongly alakaline, etc., in which a large amount of a surfactant is added in the ink, in which a water-soluble polymer is added in the ink, in which drying fixing of ink is accelerated by providing a heating drying means and the recording paper is pre-heated and heated before and after printing, and in which fixing property is improved by varying the conveyance speed of recording paper as shown in U.S. Pat. No. 4,469,026, etc. The method of making the pH of the ink strongly alkaline has such drawbacks that it is dangerous when the ink is touched with hand, and also that both blurring and dryability are not good in some cases for papers using a certain kind of sizing agent. On the other hand, in the method of adding a large amount of a surfactant, troubles arose, such as severe blurring depending on the paper, the ink was pulled from the discharge opening formed face depending on the conditions of the printer head, thus failing to discharge ink, or on the contrary, the whole of the discharge opening formed face was wetted so that no ink was discharged, etc. Further, in the method of adding a water-soluble polymer, effects can be seen to some extent concerning blurring and dryability of printing, but the ink tends to be readily dried also at the orifice tip of the discharge opening of the printer head, and when the printer is left to stand in room for several minutes without being used, there ensues the problem that no normal discharging can be effected. When the heating drying means is employed, there are involved the problems of thermal influence on the recording head, namely the problem of poor ink discharge, or the problems of mechanical and, electrical disorders of the device, further, protection of operators from burning, etc., and countermeasures thereagainst are required. Thus, it cannot necessarily be said to be a good means.

Also, when color ink jet recording is performed by use of a plurality of heads for realizing color formation, problems arise, such as insufficient drying and fixing of ink on recoding paper, lowering in image quality due to blurring of the overlapped portion of color inks and the boundary portion, and the problem of wrinkling of recording paper due to poor ink absorption at the overlapped portion. Accordingly, solutions of these problems have been directed to improvement by development of a coating paper for ink jet recording having improved ink absorption, but, on the contrary, the components in the coating layer have caused adverse effects on image quality, such as lowering in color reproducibility, poor light resistance, etc., thus posing a new problem.

SUMMARY OF THE INVENTION

Whereas, in an ink jet recording head utilizing heat energy, for such problems as ink viscosity control, ink solvent evaporation, etc., recording has been performed by elevating the ink temperature to a temperature which is higher than room temperature, but generally about 30° C. to 40° C. (the ink temperature is about 50° C. even when elevated during continuous recording). At such temperature, fixability is not at good as the initial stage of recording initiation. Accordingly, it has been necessary to improve the paper itself by heating or drying of the recording paper after recording.

However, when recording is performed continuously under these conditions over a long time, the present inventors found as the result of experiments that there is a portion where fixability of the ink was improved when discharged from a certain region of the recording head. The fact was investigated, and consequently it was discovered that the temperature elevation of the portion of the recording head where discharging is effected through the discharge opening with frequent use is higher than is expected, and has become 60° C.

In addition, the present inventors have investigated about the temperature of the ink droplets on the recording medium corresponding to that portion, carried out many experiments, and consequently found the mutual relationship between the temperature control of the recording head and the ink droplet temperature.

The present inventors have made investigations on the basis of these facts, and obtained good recording images and found improvement of fixability by driving or adding an external constitution in the recording head as a whole (whole discharging openings) so that the ink droplets may attain a temperature of 60° C. or higher from the initial stage of recording initiation.

An object of the present invention is to provide an ink jet recording method of the drop-on-demand system, wherein the problems possessed by the recording method of the prior art, namely blurring from the beginning of recording, poor dryability of printing when recorded on the so-called plain papers used in general offices, homes, etc. are solved, and at the same time safety, and reliability of the recording device are taken into consideration.

Another object of the present invention is to provide a good color ink jet recording method having excellent hue, density, and chromaticity from the beginning of recording by solving the above problems which occurs at the overlapping printed portions which enables drying and fixing of ink, particularly for a wide range of color reproduction.

Still another object of the present invention is to provide an ink jet recording method, characterized in that the temperature of the ink droplet discharged from the discharge opening by a discharge signal becomes 60° C. or higher at the printing position of a recording medium.

Still another object of the present invention is to provide an ink jet recording method by use of inks of plural colors, characterized in that:

(A) the temperature of the ink droplet discharged from the discharge opening by a discharge signal becomes 60° C. or higher at the printing position of a recording medium;

(B) the volume of said ink droplet is 40 pl or less; and (C) the recording medium is preheated at said printing position to a temperature with a range of 40° C. to 70° C.

These and other objects of the present invention will become more apparent from the following description and Examples.

DESCRIPTION OF THE PREFERRED EMBODIMENTS

Figure 1:
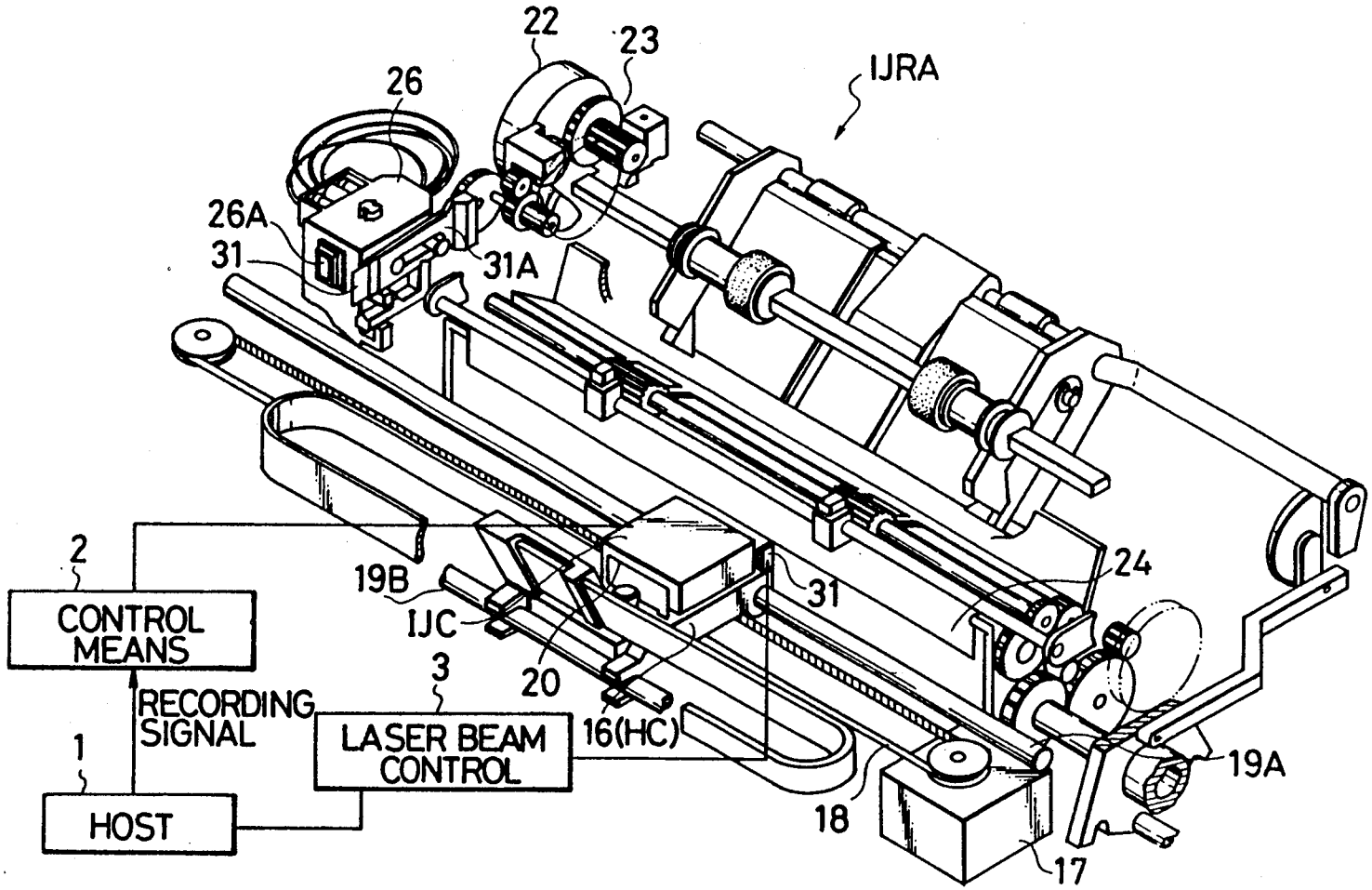
FIG. 1 is a perspective view of appearance showing an example of an ink jet recording apparatus to which the present invention can be applied.

The ink jet recording head which may be utilized in the present invention may include a head equipped with heat-generating resistors as discharge energy generators in the ink pathways connected to discharge openings.

In the recording head of this type, film boiling is caused by utilizing the heat energy generated by the heat-generating resistors during discharge of ink droplets, and ink droplets are discharged by the pressure change at that time.

A flying ink droplet generally covers the distance from the tip of a discharge opening to a recording medium of, for example, about 0.3–1.0 mm in about 100 μsec. The temperature of a flying ink droplet is mainly governed by the factor of evaporation of ink solvent and is therefore hardly lowered. Accordingly, the temperature of an ink droplet at the recording position may be considered to be the same as the temperature of ink in the recording head. When the temperature of the ink droplet at the printing position of the recording medium becomes 60° C. or lower, dryability of print becomes poor, and also the residual ink which cannot be fixed on the recording medium promotes irregular blurring of dots, which may lower the printing quality.

When the temperature of an ink droplet at the printing position of the recording medium is 60° C. or higher, the viscosity of the ink is considerably lowered, and therefore fluid resistance into the medium during collision with the recording medium becomes smaller so as to make penetration easier. Also, since the evaporation rate at the medium surface is higher, the drying and fixing is further promoted.

Accordingly, regardless of the temperature of the recording medium, if temperature control at the recording head is performed, or if an energy for elevating or keeping the temperature is applied depending on discharge timing, or if any other means capable of keeping the temperature of an ink droplet at 60° C. or higher is provided so that the temperature of an ink droplet at the printing position of the recording medium is constantly 60° C. or higher from the begining of recording, it becomes possible to perform ink jet recording with good dryability of printing and little blurring.

However, when performing overlapped printing of 2 to 3 colors, the above means is insufficient. By further providing means for reduction of the ink volume and for preservation of the temperature of an ink droplet at the printing position of the recording medium and means for pre-heating the recording medium before and after printing, the fixing property can be improved. To describe in more detail, since the lowering in temperature of an ink droplet discharged from a recording head is governed by vaporization of the ink solvent, and since the flying time is about 100 μsec, the influence of environmental temperature condition and the like upon lowering in the ink temperature is very small. Accordingly, by making about 60° C. or higher the temperature of an ink droplet being discharged from a recording head, the ink droplet temperature at the recording position of 60° C. or higher can be attained. This can be done by suitably controlling voltage, frequency, pulse width and the like of the driving signal applied to the heat energy generating member. The temperature of ink droplet at the time of arriving at the recording medium can also be adjusted to 60° C. or higher by supplying energy for elevating or keeping the ink temperature for, for example, about 20 μsec depending on the discharge timing of ink. For example, as to setting of the heating drying means for the recording medium, this will avoid thermal influences on the recording head, namely the problem of clogging due to ink evaporation acceleration at the discharge opening tip. This will also avoid mechanical or electrical disorders of the recording device, the need to protect operators from burning, etc., and will enable good drying fixing. The pre-heating temperature of the recording medium must be within the range from 35° C. to 70° C.

Also, concerning the drying and fixing within the pre-heating temperature range as mentioned above, unless the volume of the ink droplet discharged from the orifice by a discharge signal is 40 pl or less, good drying and fixing can not be obtained for overlapped printing of 2 to 3 colors, particularly when the recording medium is a plain paper. In short, the ink amount per unit area on the recording medium is an important factor having influence on drying fixing.

As the recording agent to be used in the present invention, both dyes and pigments are available, and almost all of water-soluble acidic dyes, direct dyes, basic dyes, reactive dyes described in the Color Index can be used, and further concerning pigments, they can be used under the state dispersed in an aqueous liquid medium.

Also, those not described in the Color Index can be used, provided that they are water-soluble dyes, and also as for pigments, those not described in the Color Index can be used, provided that they are dispersible into an aqueous liquid solvent.

The amount of these recording agents used is not particularly limited, but generally may be suitably within the range from 0.1 to 15% by weight based on the total weight of the recording liquid.

In the ink of the present invention, in addition to the components as described above, if necessary, there may also be added various additives such as water-soluble organic solvents, surfactants, pH controllers, rustproof agents, preservatives, antifungal agents, antioxidants, evaporation accelerators, chelating agents, water-soluble polymers, etc.

Specific examples of water-soluble organic solvents may include alkyl alcohols containing 1 to 4 carbon atoms such as methyl alcohol, ethyl alcohol, n-propyl alcohol, isopropyl alcohol, n-butyl alcohol, sec-butyl alcohol, tert-butyl alcohol, isobutyl alcohol, etc.; amides such as dimethylformamide, dimethylacetamide, etc.; ketones or ketoalcohols such an acetone, diacetone alcohol, etc.; ethers such as tetrahydrofuran, dioxane, etc.; polyalkylene glycols such as polyethylene glycol, polypropylene glycol, etc.; alkylene glycols with the alkaline group containing 2 to 6 carbon atoms such as ethylene glycol, propylene glycol, butylene glycol, triethylene glycol, 1,2,6-hexanetriol, thiodiglycol, hexylene glycol, diethylene glycol, etc.; glycerine; lower alkyl ethers of polyhydric alcohols such as ethylene glycol methyl (or ethyl) ether, diethylene glycol methyl (or ethyl) ether, triethylene glycol monomethyl (or ethyl) ether, etc.; N-methyl-2-pyrrolidone, 1,3-dimethyl-2-imidazolidinone, triethanolamine, sulforane, etc.

FIG. 1 is a perspective view showing an example of an ink jet recording apparatus (IJRA) to which the present invention can be applied.

In the Figure, 20 is an ink jet head cartridge (IJC) equipped with a group of discharge ports for performing ink discharging as opposed to the recording surface of a recording paper fed onto the platen 24. 16 is a carriage HC for holding the recording head 20, joined to a part of the driving belt 18 for transmitting the driving force of the driving motor 17, and by making it slidable with the two guide shafts 19A, 19B arranged in parallel to each other, reciprocal movement over the entire width of the recording paper of the recording head 20 becomes possible.

26 is a head restoring device and may be positioned at one end of the moving route of the recording head 20, for example, at the position opposed to the home position. By actuating the head restoring device 26 by the driving force of the motor 22 through the transmission mechanism 23, capping of the recording head 20 is performed. In connection with the capping onto the recording head 20 by means of the cap portion 26A of the head restoring device 26, ink aspiration by a suitable aspiration means provided within the head restoring device 26 or ink pressure delivery by means of a suitable pressurization means provided in the ink feeding route to the recording head 20 is performed to discharge ink compulsorily through the discharge port, thereby effecting the discharge restoration treatment such as removal of thickened ink within the ink pathways communicated to the discharge ports. Also, by capping on completion of recording, etc., the recording head can be protected.

31 is a blade as the wiping member which is arranged at the side face of the head restoring device 26, and is formed of a silicone rubber. The blade 31 is held in cantilever form on the blade holding member 31A, actuated by the motor 22 and the transmission mechanism 23 similarly as the head restoring device 26, whereby engagement with the discharge surface of the recording head 20 is rendered possible. In this way, at adequate timing during the recording actuation of the recording head 20, or after the discharge restoration treatment by use of the head restoring device 26, the blade 31 is protruded into the moving route of the recording head 20 and wipes off the dew drops, wetting or dust, etc. on the discharge surface of the head 20 as accompanied with movement actuation of the head 20.

The control, and the constitution which make the temperature of the discharged ink droplets at the shot point on the recording medium 60° C. or higher in the whole recording head from the initial stage of recording initiation are to be described below.

First example

Figure 2:
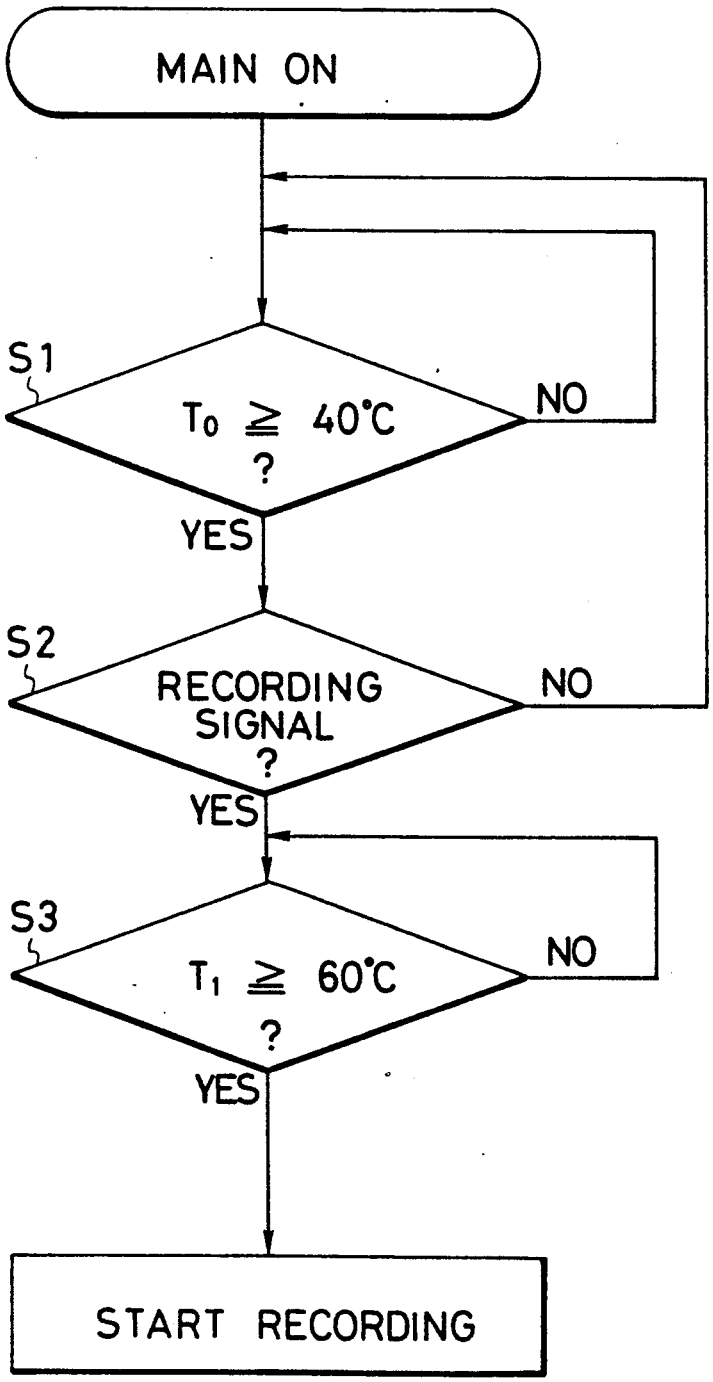
FIG. 2 is a flow chart explaining an example of the system for controlling the temperature of ink droplets.

In performing recording by means of an ink jet recording apparatus mounted with a recording head as shown in FIG. 1, first, as shown in FIG. 2, the main switches on the host 1 of the apparatus and the recording device are turned on. By input of the switches, the control means 2 of the recording apparatus is set under the conditions ready for recording initiation. Here, whether the ink temperature To has become 40° C. or not is detected in the step S1. The ink at this time may be preliminarily heated to a range from 30° C. to 50° C. If the ink is maintained at too high a temperature, evaporation of the solvent is accelerated and the ink becomes unsuitable for recording, and therefore the temperature is controlled at 30° to 50° C.

Under this state, when recording data are input from the host 1 side in the step S2, the electrothermal transducer of the recording head is driven and controlled by the control means 2, whereby the ink temperature is controlled by heating to 60° C., and after detection of this, discharging is initiated. Although the ink temperature does not reach 60° C. instantly after input of the recording data, the time lag can be not so great before the further temperature control of the temperature controlled ink to the higher temperature side, and therefore there is no substantial influence given to recording. Since the ink droplet temperature after discharging is substantially unchanged from the ink temperature at the recording head if the distance from the discharging opening to the recording medium is about 0.3 to 1.5 mm, the ink temperature on the recording head side may be measured and controlled.

In a recording head of the type which discharges ink droplets by utilizing head energy as in this Example, the ink temperature at this time should be preferably controlled to 60° C. to 70° C. Also, in the type utilizing an electro-mechanical transducer, the ink temperature should be preferably controlled to 65° C. to 75° C.

The temperature of the ink being discharged from the recording head can be controlled by varying the driving conditions of the heat-generating resistors equipped in the recording head.

Alternatively, heater(s) for ink temperature control, etc. may be also so equipped.

Second example

In a recording apparatus as shown in FIG. 1, after the main switch is turned on, the ink temperature is controlled to about 30° C. to 50° C. as described above.

Then, ink droplets are discharged by the input of the recording data. As synchronized with discharging of the ink droplets, a laser beam is radiated on the flying ink droplets from a laser beam irradiation source 31 by controlling the laser beam with the control means 3 provided separately on the apparatus side shown in FIG. 1 to make the temperature of the ink droplets 60° C. or higher. The laser beam irradiation source 31 may be provided on the carriage or on either one end in the head scanning direction. By this operation, the ink droplet temperature at the printing position of the recording medium can be made 60° C. or higher.

The ink droplet temperature can be made a desired temperature by varying the irradiation energy of the laser beam.

In addition to these first and second examples, various constitutions are applicable which can make the ink droplet temperature 60° C. or higher at the recording position of the recording medium from the initial stage of recording initiation, provided that they do not depart from the spirit of the present invention.

As described above, particularly when the type of the recording head is one utilizing heat energy, if the distance between the discharge opening surface and the recording medium is 0.3 to 1.5 mm, the temperature of the recording head and the temperature of the ink droplets when shot on the recording medium become substantially equal, or the shot ink becomes slightly higher. This is because high heat energy so as to cause film boiling to occur is momentarily applied on the ink during ink discharging. Accordingly, the ink temperature is momentarily elevated, and in this case, the desired object can be also accomplished even if the temperature control of the recording head may be made about 55° C.

The present invention is described in more detail by referring to the Examples to which the first example wherein the heat generation temperature of the recording head is controlled is applied. However, the scope of the present invention is not limited thereby at all. In the ink examples, % indicates all % by weight.

EXAMPLES 1–4 AND COMPARATIVE EXAMPLES 1–3

The inks (1)–(7) in Table 1 were mounted on a modified product of an ink jet printer BJ-130 (Canon), and printing was performed on a commercially available copying paper. The recording conditions and the recording characteristics are shown in Table 2 and Table 3.

Evaluation method and Evaluation standards

Temperature measurement of an ink droplet at printing position

A thermocouple was provided on the surface of the platen for holding the recording medium, and the temperature of the ink droplet discharged from one orifice by discharge signal at one time was measured by electrical recognition. The temperature of the ink droplet was performed by controlling the temperature by the above described method, namely, suitably selecting applied voltage, applied pulse width, applied frequency and the like to the recording head.

Dryability of print

Dryability of print was judged on the basis of the count of seconds until the printed portion was no longer contaminated, when English and numerical letters were printed on a commercially available paper for continuous slip, and then rubbed with a filter paper [Toyo Roshi, No. 2 (trade name)] 10, 20, 30, 40, 50 and 60 seconds later (measured at 20° C.±5° C., 50±10% RH).

◎: within 10 seconds
○: within 10–20 seconds
Ⓐ : within 15–25 seconds
Δ: within 20–40 seconds
×: 40 seconds or longer.

Printing quality

For printing quality, after printing was performed on a commercially available copying paper, the print was left to stand for one hour to be sufficiently dried, and then blurring and sharpness at edge at dot level were evaluated (evaluated under the environmental condition of 25° C., 60% RH).

◎: blurring, and edge is very sharp
○: blurring more or less observed, but edge of dot is sharp
Ⓐ : blurring exists considerably, but edge of dot is such as to afford use as a general purpose machine
Δ: blurring observed in substantially all dots, and edge of dot is slightly obscure
×: blurring observed in all dots, and edge of dot is also indistinct.

EXAMPLE 5 TO 8 AND COMPARATIVE EXAMPLES 4 TO 15

By use of a modified product of an ink jet printer BJ-130 (Canon), ink jet color recording was performed on two kinds of a commercially available copying paper and a coated paper for ink jet. The recording conditions at this time, and the results of image evaluation and clogging of the nozzle are shown in Table 4 and Table 5.

For inks, the two kinds shown below were employed.

| | |
|---|---|
| Ink example 8 | |
| (Yellow ink) | |
| Ethylene glycol | 5% |
| Glycerine | 10% |
| C.I. Direct Yellow 86 | 2% |
| $H_2O$ | 83% |
| (Magenta ink) | |
| Ethylene glycol | 5% |
| Glycerine | 10% |
| C.I. Direct Red 227 | 2% |
| $H_2O$ | 83% |
| (Cyan ink) | |
| Ethylene glycol | 5% |
| Glycerine | 10% |
| C.I. Direct Blue 199 | 2% |
| $H_2O$ | 83% |
| (Black ink) | |
| Ink of ink example 1. | |
| Ink example 9 | |
| (Yellow ink) | |
| Diethylene glycol | 20% |
| Glycerine | 15% |
| C.I. Direct Yellow 86 | 2% |
| $H_2O$ | 63% |
| (Magenta ink) | |

-continued

| | |
|---|---|
| Diethylene glycol | 20% |
| Glycerine | 15% |
| C.I. Direct Red 227 | 2% |
| $H_2O$ | 63% |
| (Cyan ink) | |
| Diethylene glycol | 20% |
| Glycerine | 15% |
| C.I. Direct Blue 199 | 2% |
| $H_2O$ | 63% |
| (Black ink) | |
| Ink of ink example 1. | |

Evaluation and measurement methods

Temperature measurement of ink droplet at printing position

A thermocouple was provided on the surface of the platen for holding the recording medium, and the temperature of the ink droplet discharged from one orifice by discharge signal at one time was measured by electrical recognition. The temperature of the ink droplet was performed by controlling the temperature of the recording head.

Volume measurement of an ink droplet at printing position

Discharge volume of one ink droplet was measured from the reduced amount in the ink tank connected to the nozzles and the solid black recording area after solid black recording was performed which discharged ink droplets through all the nozzles of the recording head over the whole of the recording area.

Pre-heating temperature measurement of recording medium

By temperature control of a heat-generating member by providing a temperature sensor on the heating platen mounted on an ink jet printer BJ-130 (Canon), the temperature was controlled to a desired one.

Evaluation of clogging of nozzle

When continuous printing was performed for 10 minutes by giving discharge signals to predetermined nozzles of the recording head, and then by giving discharge signals to the remaining unused nozzles to perform printing, presence of bad sites such as dimness, void, etc. was judged (measured at 20° C.±5° C., 50±10% RH).

As the ink to be used in the present invention, one with a water content of 70% or more is preferable. When an ink with a water content of less than 70% is used, the temperature of the ink droplet at the printing position of a recording medium should be preferably made 65° C. or higher.

The present invention brings about excellent effects particularly in a recording head, recording apparatus of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation according nucleus boiling corresponding to the recording information on an electro-thermal transducer arranged corresponding to the sheets or liquid paths holding liquid (ink), heat energy is generated at the electro-thermal transducer to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat No. 4,313,124 of the invention concerning the temperature elevation rate of the above-mentioned heat acting surface.

As the constitution of the recording head, in addition to the combination constitutions of discharging opening liquid path, electro-thermal transducer (linear liquid path or right angle liquid path) as disclosed in the above-mentioned respective specifications, the constitution by use of U.S. Pat. Nos. 4,558,333 and 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electro-thermal transducer as the discharging portion of the electro-thermal transducer or Japanese Patent Laid-Open Application No. 59-138461 which discloses the constitution having the opening for absorbing pressure wave of heat energy correspondent to the discharging portion.

Further, as the recording head of the full line type having a length corresponding to the maximum width of recording medium which can be recorded by the recording apparatus, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main of the apparatus by being mounted on the main body of the apparatus or for the case by use of a recording head of the cartridge type provided integrally on the recording head itself.

Also, addition of a restoration means for the recording head, a preliminary auxiliary means, etc. provided as the constitution of the recording apparatus of the present invention is preferable, because the effect of the present invention can be further stabilized. Specific examples of these may include, for the recording head, capping means, cleaning means, pressurization or aspiration means, electro-thermal transducer or another heating element or preliminary heating means according to a combination of these, and it is also effective for performing stable recording to perform preliminary mode which performs discharging separate from recording.

Further, as the recording mode of the recording apparatus, the present invention is extremely effective for not only the recording mode only of a primary stream color such as black, etc., but also an apparatus equipped with at least one of plural different colors or full color by color mixing, whether the recording head may be either integrally constituted or combined in plural number.

In the examples of the present invention as set forth above, the use of liquid ink is discussed but any ink which is solid or softened at room temperature may also be used in the present invention. In the ink jet recording apparatus as described above it is a common practice to control the temperature of ink itself within a range of 30° to 70° C., thus adjusting the viscosity of the ink to be within the stable ejection range. Accordingly any ink which is liquid upon applying a recording signal may be used. Furthermore, any ink which is liquefied upon application of thermal energy may also be used in the present invention. Such a type of inks include, for example, one which upon application of thermal energy depending on recording signal, is liquefied to be ejected in the form of ink droplet and one which is being solidified at the time of arriving at a recording medium. Such a type of ink are used for the purpose of, for example, positively utilizing thermal energy as the energy for phase change of ink from solid to liquid to prevent temperature elevation due to thermal energy or using an ink which is solidified when left to stand to prevent evaporation of ink. When such an ink is to be used, the ink may be held in the form of liquid or solid in recessed portions or through holes of a porous sheet while facing the electrothermal transducer as shown in, for example, Japanese Laid Open Patent Application Nos. 54-56847 and 60-71260. In the present invention, the most useful system for use of the inks as described above is the system effective film boiling as described above.

As described above, according to the present invention, a recording method can be obtained, which is extremely good in dryability from the begining of the recording and also good in printing quality, even when recording is performed on a commercially available paper in general, such as paper of notebook, report paper, copying paper, letter paper, post card, etc.

Further, according to the present invention, good ink jet color recording can be obtained on a special paper for ink jet as a matter of course, but also on a plain paper in general. Particularly, since quick drying fixing can be effected from the begining of the recording for overlapped printing for twice to three times, a wide range of color reproducibility is possible, and also highly precise color image quality can be obtained.

TABLE 1

| Ink component | Ink example 1 | 2 | 3 | 4 | 5 | 6 | 7 |
|---|---|---|---|---|---|---|---|
| Ethylene glycol | 5% | | | | | 10% | |
| Diethylene glycol | | 15% | 5% | | | | 20% |
| Triethylene glycol | | | 10% | | | 15% | |
| Glycerine | 10% | | | 20% | | | 15% |
| Thiodiglycol | | | | | 10% | | |
| Ethanol | | | 5% | | | | |
| Scoreroll #700 | | 0.01% | | | | | |
| Triethylene glycol monomethyl ether | | | | | 5% | | |
| C.I. Direct Black 154 | 3% | 3% | 3% | 3% | 3% | 3% | 3% |
| $H_2O$ | 82% | 81.99% | 77% | 77% | 82% | 72% | 62% |

TABLE 2

| | Ink droplet temperature at printing position | Dryability of Print: Ink No. 1 | 2 | 3 | 4 | 5 | 6 | 7 |
|---|---|---|---|---|---|---|---|---|
| Example | | | | | | | | |
| 1 | 80° C. | ◎ | ◎ | ◎ | ◎ | ◎ | ◎ | ◎ |
| 2 | 70° C. | ◎ | ◎ | ◎ | ○~◎ | ◎ | ○~◎ | ○ |
| 3 | 65° C. | ○ | ◎ | ◎ | ○ | ◎ | ○ | ○ |
| 4 | 60° C. | ○ | ○ | ○ | ○ | ○ | Δ | Δ |
| Comparative example | | | | | | | | |
| 1 | 55° C. | Δ | Δ | Δ | Δ | Δ | X | X |
| 2 | 50° C. | X | X | Δ | X | Δ | X | X |
| 3 | 40° C. | X | X | X | X | X | X | X |

TABLE 3

| | Ink droplet temperature at printing position | Printing Quality: Ink No. 1 | 2 | 3 | 4 | 5 | 6 | 7 |
|---|---|---|---|---|---|---|---|---|
| Example | | | | | | | | |
| 1 | 80° C. | ◎ | ◎ | ◎ | ◎ | ◎ | ◎ | ◎ |
| 2 | 70° C. | ◎ | ◎ | ◎ | ◎ | ◎ | ○~◎ | ○ |
| 3 | 65° C. | ◎ | ○ | ◎ | ◎ | ◎ | ○ | ○ |
| 4 | 60° C. | ○ | ○ | ○ | ○ | ○ | Δ | Δ |
| Comparative example | | | | | | | | |
| 1 | 55° C. | Δ | Δ | Δ | ○ | Δ | X | X |
| 2 | 50° C. | Δ | X | X | Δ | X | X | X |
| 3 | 40° C. | X | X | X | Δ | X | X | X |

TABLE 4

| | Pre-heating temperature of recording paper | (Commercially available copying paper/ Coated paper for ink jet) Clogging of nozzle | Overlapping times of ink droplets | Volume of ink droplet (pl): 25 | 35 | 45 | 55 |
|---|---|---|---|---|---|---|---|
| Comparative example 4 | 35° C. | ◎ | 2 | Δ~X/◎ | X/○ | X/Δ | X/X |

TABLE 4-continued

| | Pre-heating temperature of recording paper | (Commercially available copying paper/ Coated paper for ink jet) Clogging of nozzle | Overlapping times of ink droplets | Volume of ink droplet (pl) 25 | 35 | 45 | 55 |
|---|---|---|---|---|---|---|---|
| 5 | | | 3 | X/◎~○ | X/Δ | X/X | X/X |
| Example | | | | | | | |
| 5 | 50° C. | ○~◎ | 2 | ◎~○/◎ | ○/◎ | Δ~X/○~◎ | X/Δ |
| 6 | | | 3 | ○/◎ | ○~Δ/○~◎ | X/Δ~X | X/X |
| 7 | 60° C. | ○ | 2 | ◎/◎ | ◎~○/◎ | Δ/◎ | X/○~Δ |
| 8 | | | 3 | ◎/◎ | ○/◎ | Δ~X/○~Δ | X/Δ~X |
| Comparative example | | | | | | | |
| 6 | 75° C. | Δ~X | 2 | ◎/◎ | ◎/◎ | ○~Δ/◎ | Δ/○ |
| 7 | | | 3 | ◎/◎ | ○~◎/◎ | Δ/○ | X/Δ |

Color recording was performed under the condition of 65° C. of the ink droplet temperature at the printing position.
Evaluation standards:
Extent of blurring at ink overlapped portion and boundary portion
Presence of contact contamination with recording head due to rippling of recording paper

TABLE 5

| | Ink droplet Temperature at printing position | (Commercially available copying paper/ Coated paper for ink jet) Overlapping times of ink droplets | Volume of ink droplet (pl) 25 | 35 | 45 | 55 |
|---|---|---|---|---|---|---|
| Comparative Example 8 | 40° C. | 2 | X/○ | X/Δ | X/X | X/X |
| Comparative Example 9 | | 3 | X/Δ | X/X | X/X | X/X |
| Comparative Example 10 | 50° C. | 2 | X/○ | X/Δ~○ | X/X | X/X |
| Comparative Example 11 | | 3 | X/○~Δ | X/Δ~X | X/X | X/X |
| Comparative Example 12 | 65° C. | 2 | Δ~X/◎ | X/○ | X/Δ | X/X |
| Comparative Example 13 | | 3 | X/◎~○ | X/Δ | X/X | X/X |
| Comparative Example 14 | 75° C. | 2 | ○~Δ/◎ | Δ/◎ | X/○~Δ | X/Δ |
| Comparative Example 15 | | 3 | Δ~X/◎ | X/○~Δ | X/X | X/X |

Color regarding was performed under the condition without pre-heating (25° C.).
Evaluation standards:
Extent of blurring at ink overlapped portion and boundary portion
Presence of contact contamination with recording head due to rippling of recording paper

What is claimed is:

1. An ink jet recording method wherein an ink is discharged from an ink discharge opening in accordance with a discharging signal to effect recording, which comprises:

driving an ink droplet volume discharging means to provide an ink droplet as discharged from the ink discharge opening in accordance with the discharging signal having a volume of no greater than 40 pl; and irradiating the discharged ink droplet with a laser to provide a temperature of the ink droplet at an ink deposition point on a recording medium to which the recording is effected of at least 60° C.

2. An ink jet recording method wherein an ink droplet is discharged from each of a plurality of ink discharge openings in accordance with a discharging signal to effect recording, which comprises:

driving an ink droplet discharging means to provide an ink droplet volume as discharged from the ink discharge opening in accordance with the discharging signal for forming one picture element by superimposition of a plurality of the ink droplets, each said ink droplet having a volume of no greater than 40 pl; and adjusting the ink discharging means to provide a temperature of the discharged ink droplet at an ink deposition point on a recording medium to which the recording is effected of at least 60° C.

* * * * *

UNITED STATES PATENT AND TRADEMARK OFFICE

CERTIFICATE OF CORRECTION

PATENT NO. : 5,148,186

DATED : September 15, 1992

INVENTOR(S) : SHINICHI TOCHIHARA, ET AL.

It is certified that error appears in the above-identified patent and that said Letters Patent is hereby corrected as shown below:

COLUMN 1

Line 13, "method" should be deleted.
Line 32, "so called" should read --so-called--.
Line 43, "problems" should read --problems,--.
Line 44, "to" should read --will--.
Line 50, "the method" should be deleted.

COLUMN 2

Line 13, "and," should read --and--.
Line 42, "at good as" should read --as good at--.
Line 57, "about" should be deleted.

COLUMN 3

Line 8, "safety," should read --safety--.
Line 13, "occurs" should read --occur--.

COLUMN 4

Line 7, "smaller" should read --smaller,--.
Line 41, "ink" should read --an ink--.

COLUMN 5

Line 25, "an" should read --as--.
Line 29, "alkaline" should read --alkylene--.

COLUMN 6

Line 22, "to be" should be deleted.

--

UNITED STATES PATENT AND TRADEMARK OFFICE

CERTIFICATE OF CORRECTION

PATENT NO. : 5,148,186

DATED : September 15, 1992

INVENTOR(S) : SHINICHI TOCHIHARA, ET AL.

It is certified that error appears in the above-identified patent and that said Letters Patent is hereby corrected as shown below:

COLUMN 7

Line 65, "performed" should read --set--.

COLUMN 8

Line 28, "general purpose" should read --general-purpose--.
Line 33, "EXAMPLE 5" should read --EXAMPLES 5--.

COLUMN 9

Line 15, "ink" should read --an ink--.
Line 22, "performed" should read --set--.
Line 58, "tem." should read --tems.--.
Line 63, "so called" should read --so-called--.
Line 66, "according" should read --exceeding--.

COLUMN 10

Line 23, "right angle" should read --right-angle--.
Line 33, "transducer" should read --transducers--.
Line 52, "main" should read --main body--.

COLUMN 11

Line 30, "Accordingly" should read --Accordingly,--.
Line 48, "Laid Open" should read --Laid-Open--.
Line 51, "effective" should read --effecting--.
Line 54, "begining" should read --beginning--.

--

UNITED STATES PATENT AND TRADEMARK OFFICE

CERTIFICATE OF CORRECTION

PATENT NO. : 5,148,186

DATED : September 15, 1992

INVENTOR(S) : SHINICHI TOCHIHARA, ET AL.

It is certified that error appears in the above-identified patent and that said Letters Patent is hereby corrected as shown below:

COLUMN 12

Line 7, "begining" should read --beginning--.

COLUMN 13

TABLE 5, "regarding" should read --recording--.

Signed and Sealed this

Twenty-sixth Day of October, 1993

*Attest:*

*Attesting Officer*

BRUCE LEHMAN

*Commissioner of Patents and Trademarks*